US006924778B2

(12) United States Patent
Awamoto et al.

(10) Patent No.: US 6,924,778 B2
(45) Date of Patent: Aug. 2, 2005

(54) METHOD AND DEVICE FOR IMPLEMENTING SUBFRAME DISPLAY TO REDUCE THE PSEUDO CONTOUR IN PLASMA DISPLAY PANELS

(75) Inventors: Kenji Awamoto, Kawasaki (JP); Kunio Takayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 66 days.

(21) Appl. No.: 09/989,117

(22) Filed: Nov. 21, 2001

(65) Prior Publication Data

US 2002/0190925 A1 Dec. 19, 2002

(30) Foreign Application Priority Data

Jun. 18, 2001 (JP) ..... 2001-182953

(51) Int. Cl.[7] ..... G09G 3/28

(52) U.S. Cl. ..... 345/60; 345/147; 345/148; 345/61; 345/63

(58) Field of Search ..... 345/60, 147, 63

(56) References Cited

U.S. PATENT DOCUMENTS 6,297,788 B1 * 10/2001 Shigeta et al. ..... 345/63
6,414,657 B1 * 7/2002 Kasahara et al. ..... 345/63
6,529,204 B1 * 3/2003 Mikoshiba et al. ..... 345/597
6,593,903 B2 * 7/2003 Nakamura et al. ..... 345/60

* cited by examiner

*Primary Examiner*—Sumati Lefkowitz
*Assistant Examiner*—Ming-Hun Liu
(74) *Attorney, Agent, or Firm*—Staas & Halsey LLP

(57) ABSTRACT

A method for driving a plasma display panel is provided in which dynamic pseudo contours are reduced and pattern noises are suppressed so that image quality of an animation display is improved. In the method, a superposition method is applied only to the area of a display image, which is made of pixels having a gradation at which only one of plural subframes having the same luminance weight concerning the superposition method is lighted and has a luminance gradient within a preset value range between the neighboring pixels.

8 Claims, 9 Drawing Sheets

METHOD AND DEVICE FOR IMPLEMENTING SUBFRAME DISPLAY TO REDUCE THE PSEUDO CONTOUR IN PLASMA DISPLAY PANELS

BACKGROUND OF THE INVENTION

1. Field of the Invention

The present invention relates to a method and a device for driving an AC type plasma display panel.

A plasma display panel (PDP) has two features of high speed and high resolution that are suitable for television sets and computer monitors. A PDP is used for a large screen display device. One of tasks about a PDP is to reduce a pseudo contour of an animation display.

2. Description of the Prior Art

For a gradation display using a PDP, a method is widely used that comprises the steps of replacing one frame with a plurality of subframes having weights of luminance, and setting on and off of light emission of each cell of a subframe. For example, cells are lighted only in subframes having weight 1 for gradation 1 and are lighted in subframes having weight 2 and in subframes having weight 8 for gradation 10, so that each of gradation levels corresponds to a combination of subframes to be lighted (this is called a subframe expression). Usually, the conversion from a frame into subframes is performed by using a conversion table that was made in advance. In the case of an interlace display, each of fields of a frame is made of plural subfields, and the lighting control is performed for each subfield. However, contents of the lighting control are similar to the case of a progressive display.

In a display by controlling lighting for each subframe, there is a problem of dynamic pseudo contours that can occur due to discrete light emission timing in a frame period. The dynamic pseudo contour is a phenomenon that an observer recognizes light and dark patterns that is not the display contents. Especially, the dynamic pseudo contour can occur easily when an image portion including pixels with similar gradation levels and having a gentle gradient of luminance moves in the screen. For example, in a scene where a man walks, the head portion of the man may generate the dynamic pseudo contour. In a static picture shown in FIG. 8A, areas of Gradation 2, Gradation 3, Gradation 4 and Gradation 5 are observed correctly, while a moving picture shown in FIG. 8B is observed as if a dark line exists at the boundary between the areas of the Gradation 3 and the Gradation 4. There is also a case where a moving picture is observed as if a light line exists depending on a movement of a line of sight.

FIGS. 9A–9C show a concept of a superposition method. The superposition method is used for reducing dynamic pseudo contours. In the superposition method, at least one group of two subframes having the same luminance weight is provided. FIG. 9A shows an example of providing Weight 4 in a structure having four subframes, in which a frame period is divided into four subframe periods Tsf1, Tsf2, Tsf3 and Tsf4t. Italic numerals in FIG. 9A show the weights. The cells in the display screen are classified into Group A and Group B as shown in FIG. 9B. A typical arrangement of cells is a checked pattern arrangement. In the gradations in which one of the two subframes having the same weight is lighted (i.e., the Gradation 4, the Gradation 5, the Gradation 6 and the Gradation 7 in the illustrated example), one subframe of the Weight 4 (the front side in the illustrated example) is lighted for cells of the Group A, while the other subframe is lighted for cells of the Group B. For example, when a display changes from the Gradation 3 to the Gradation 4 as shown in FIG. 9C, a light emission period becomes longer in cells of the Group B than in cells of the Group A. On the contrary, the light emission period becomes longer in cells of the Group A than in cells of the Group B when the display changes from the Gradation 4 to the Gradation 3. In this way, the light emission period is different between the Group A and the Group B despite of the same gradient of gradation. Therefore, the dynamic pseudo contour has a pattern in which a light portion and a dark portion interchange with each other for every cell as shown in FIG. 10. This pattern is a fine pattern that cannot be recognized in a usual observation. Namely, in the superposition method, the luminance is equalized by dispersing the light and dark for gradation portions having a tendency to generate the dynamic pseudo contour. Thus, the dynamic pseudo contour becomes inconspicuous visually.

However, in the conventional driving method using the superposition method, a check pattern noise can occur as shown in FIG. 11. For example, if the area of the uniform luminance of the Gradation 4 is spread widely in the display screen when performing the above-mentioned superposition process of the example shown in FIG. 9, light emission becomes a check pattern in the whole of the area. In a moving picture in which a wide area of the check pattern moves, an observer who traces the movement may recognize a luminance difference between the Group A and the Group B. Namely, if the area in which the luminance is equalized by the superposition process is wide, since the Group A and the Group B are distributed periodically, human eyes can observe the light and dark patterns even after the luminance is equalized. Thus, the image quality is deteriorated.

SUMMARY OF THE INVENTION

An object of the present invention is to reduce dynamic pseudo contours and to suppress generation of a pattern noise, so that image quality of an animation display can be improved.

According to the present invention, the superposition method is applied to a display image only in a specific area that satisfies the following condition (1). (1) The specific area is made of pixels having a specific gradation and has a luminance gradient within a preset value range between the neighboring pixels (the specific gradation means a gradation where only one of plural subframes having the same luminance weight in the superposition method is lighted).

The superposition method is not applied to a wide spread area having uniform luminance even if it has a specific gradation, and the gradation is reproduced by a single subframe expression. Therefore, a pattern noise is not generated.

In addition, it is verified by an experiment that a pattern noise appears conspicuously when an observer traces an area having a specific gradation moving in a screen or another area having another gradation moving so as to cross the area having the specific gradation in the screen. Therefore, by adding another condition of being a portion of a moving object to the condition (1), the pattern noise is reduced more.

DESCRIPTION OF THE PREFERRED EMBODIMENTS

Hereinafter, the present invention will be explained more in detail with reference to embodiments and drawings.

[First Embodiment]

Figure 1:
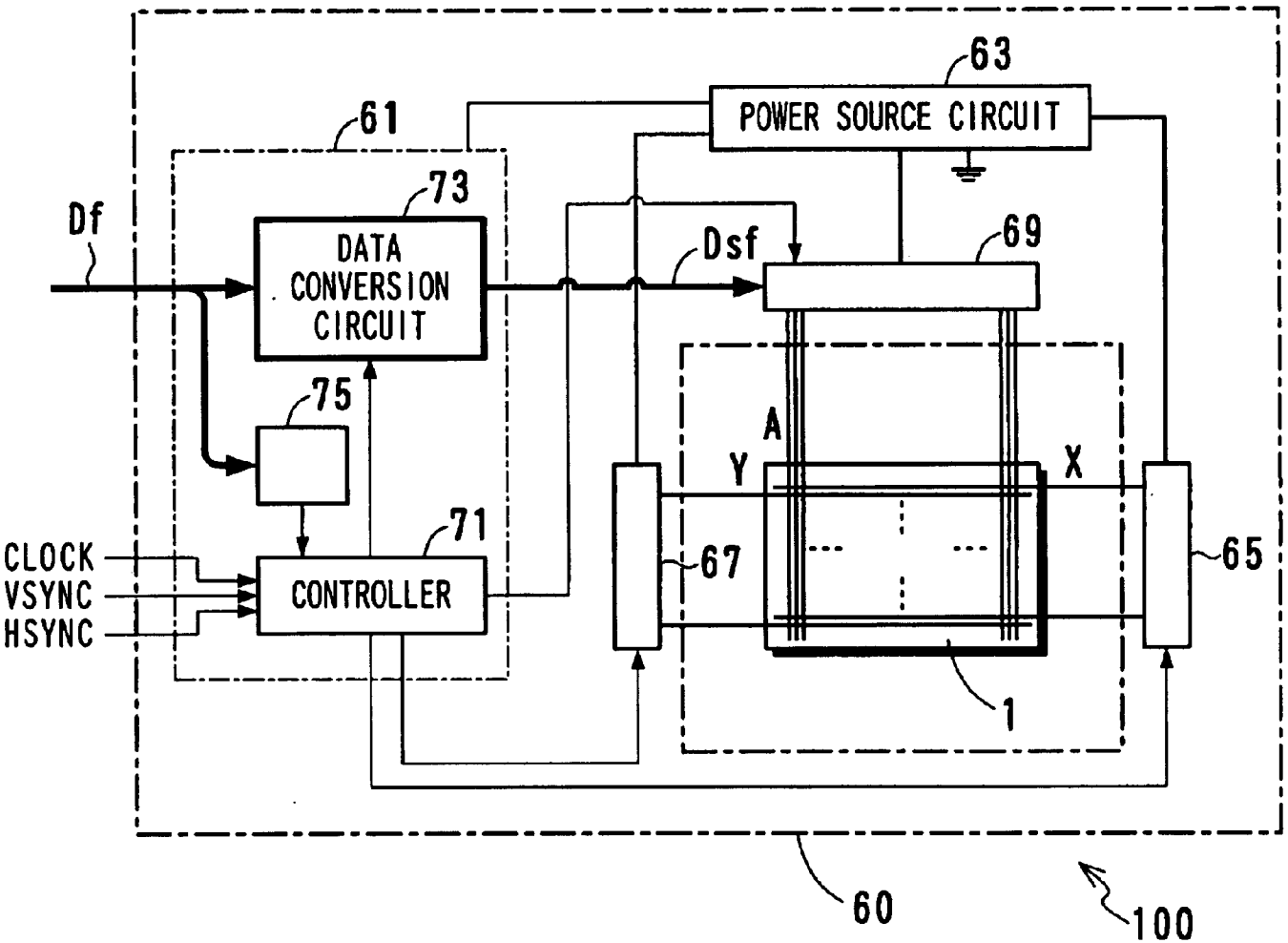
FIG. 1 shows a structure of a display device according to a first embodiment.

FIG. 1 shows a structure of a display device according to a first embodiment. The display device 100 comprises a surface discharge type PDP 1 having a screen of m columns and n rows, and a drive unit 60 for lighting m×n cells selectively. The display device 100 is used as a wall-hung television set or a monitor of a computer system.

PDP 1 includes display electrodes X and Y arranged in parallel for generating display discharge, and address electrodes A arranged so as to cross the display electrodes. The display electrodes X and Y extend in the row direction of the screen (in the horizontal direction), and the display electrode Y is used as a scan electrode for selecting a row upon addressing. The address electrode A extends in the column direction (in the vertical direction) and is used as a data electrode for selecting a column. A color arrangement of the color display has a stripe pattern in which red, green and blue colors are disposed alternately in the horizontal direction.

The drive unit 60 includes a control circuit 61, a power source circuit 63, an X-driver 65, a Y-driver 67 and an A-driver 69. The control circuit 61 includes a controller 71, a data conversion circuit 73 and a display load factor detection circuit 75. The control circuit 61 is supplied with frame data Df indicating luminance levels of red, green and blue colors together with synchronizing signals CLOCK, VSYNC and HSYNC from an external device such as a TV tuner or a computer. The frame data Df are full color data of 24 bits for one pixel of three colors. The data conversion circuit 73 converts the frame data Df into subframe data Dsf for a gradation display. A value of each bit of the subframe data Dsf indicates whether the corresponding cell of a subframe should be lighted or not, more precisely whether address discharge is necessary or not. In the case of an interlace display, each of plural fields of a frame is made of plural subfields, and the light emission control is performed for each subfield. However, contents of the light emission control are the same as in the case of a progressive display. The X-driver 65 controls potentials of n display electrodes X, and the Y-driver 67 controls potentials of n display electrodes Y. The A-driver 69 controls potentials of total m of address electrodes A in accordance with the subframe data Dsf from the data conversion circuit 73. These drivers are supplied with a control signal from the controller 71 and are supplied with a predetermined power from the power source circuit 63. The display load factor detection circuit 75 refers the frame data Df and calculates the display load factor for each frame. The display load factor is defined as an average value of a ratio Di/Dmax over all cells where Di ($0 \leqq Di \leqq Dmax$) is a gradation value of a cell i in a frame. The display load factor is used for an automatic power control (APC) performed by the controller 71.

Figure 2:
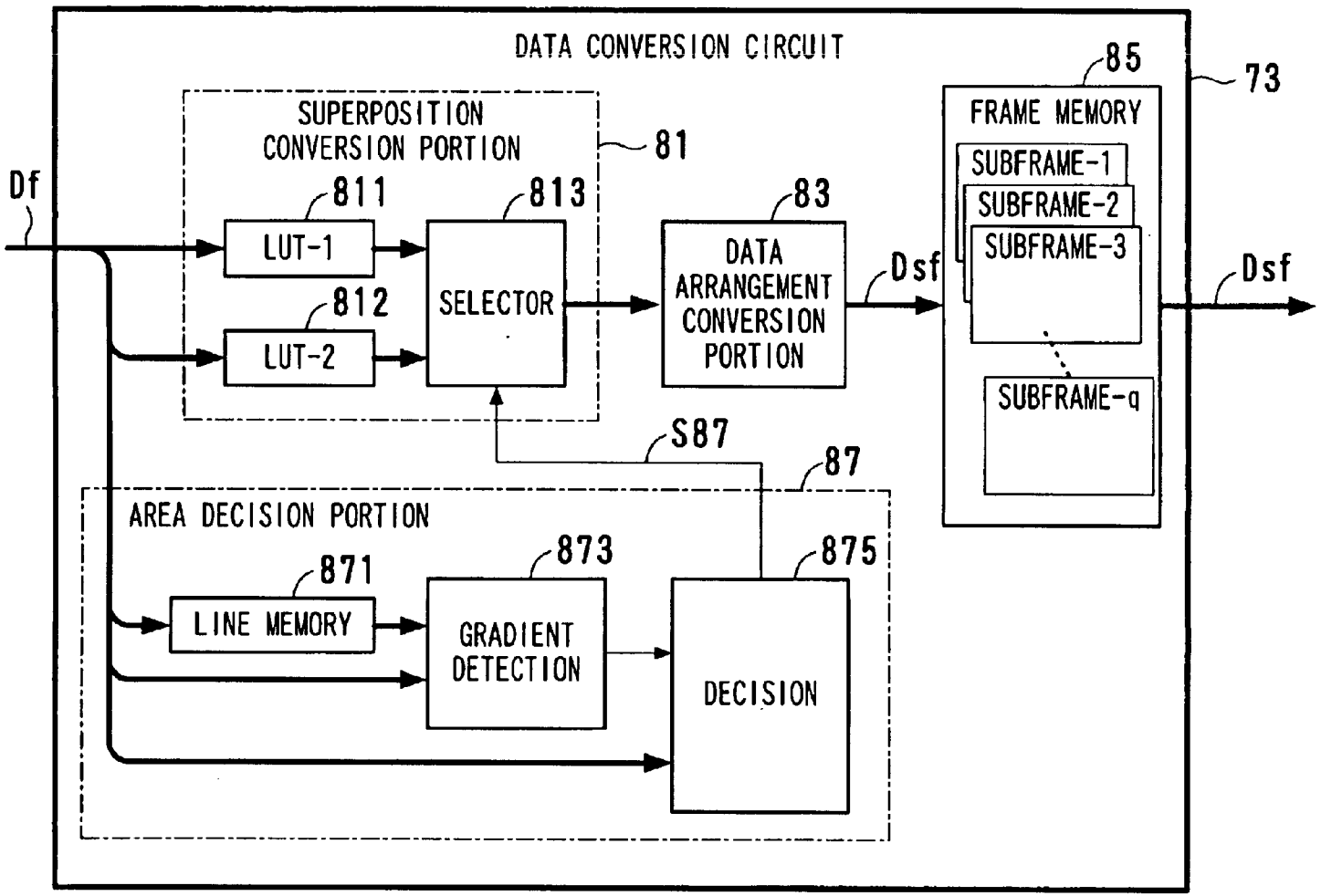
FIG. 2 shows a structure of a data conversion circuit.

FIG. 2 shows a structure of the data conversion circuit. The data conversion circuit 73 includes a superposition conversion portion 81, a data arrangement conversion portion 83, a frame memory 85 and an area decision portion 87 that is unique to the present invention.

Figure 10:
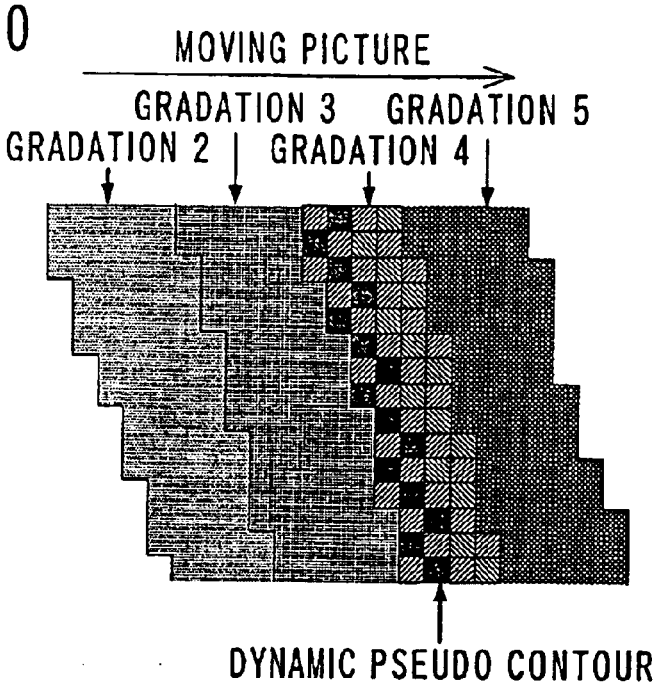
FIG.10 PRIOR ART
FIG. 10 shows reduction of dynamic pseudo contours according to the conventional driving method.
Figure 11:
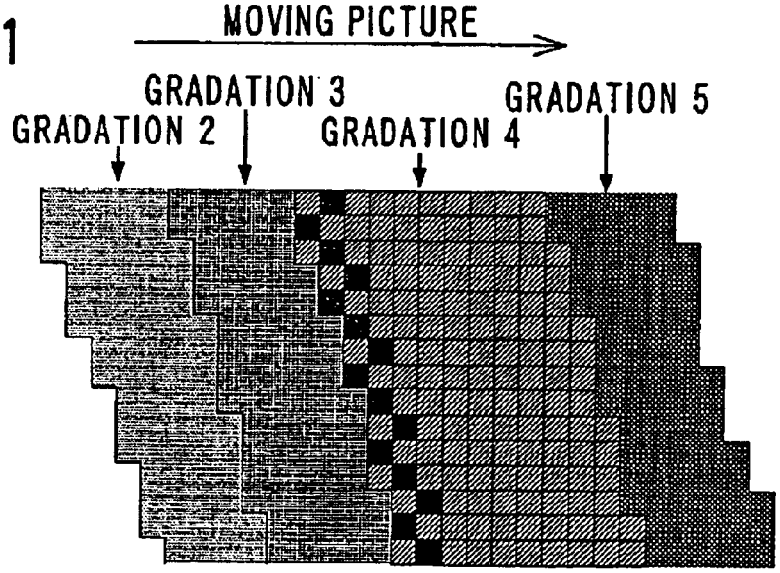
FIG.11 PRIOR ART
FIG. 11 shows a deterioration of image quality in the conventional method.

The frame data Df are imparted simultaneously to two look-up table memories 811 and 812 of the superposition conversion portion 81 in synchronization with a pixel transfer clock. The look-up table memories 811 and 812 output q bit data indicating a predetermined subframe expression for a gradation indicated by 8 bits per color (other bits are possible though image data usually have 8 bits per color). Here, q is equal to the number of subframes for one frame. The look-up table memories 811 and 812 store the conversion tables that assign different subframe expressions to a specific gradation and the same subframe expression to the other gradation. One of the outputs of the look-up table memories 811 and 812 is selected by a selector 813. The selector 813 changes the selection alternately for one pixel in the horizontal direction and for one row in the vertical direction as a basic operation. By this operation, the distribution of cells in the checked pattern that was explained with reference to FIG. 10 is realized. The data of each color outputted by the selector 813 are converted into the subframe data Dsf for each subframe in the data arrangement conversion portion 83. The subframe data Dsf are temporarily stored in the frame memory 85 and then transferred to the A-driver 69 in accordance with the progress of the display. Though the superposition conversion portion 81 is structured using the look-up table memory and the selector in the above-mentioned example, other structure having the same operational function is possible. For example, subframe displays can be mapped by changing an address of a look-up table having two areas.

Figure 9A:
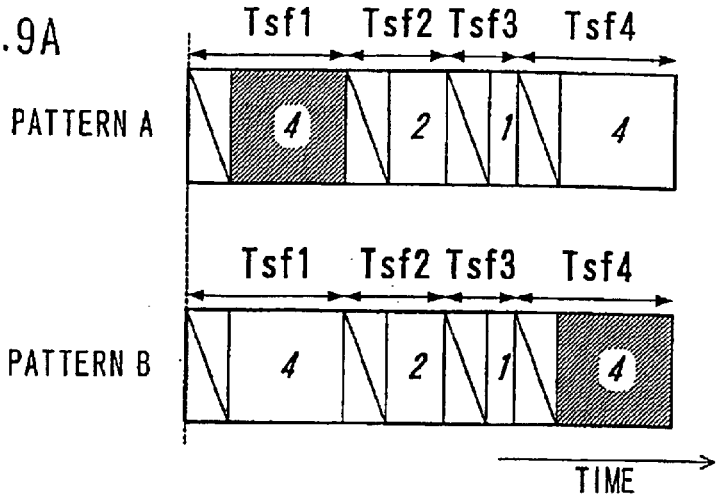
PRIOR ART FIG.9A
FIGS. 9A–9C show a concept of a superposition method.
Figure 9B:
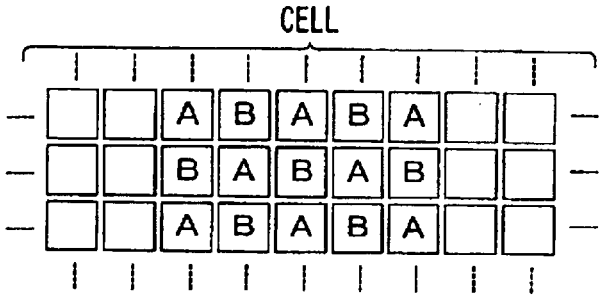
FIG.9B PRIOR ART
Figure 9C:
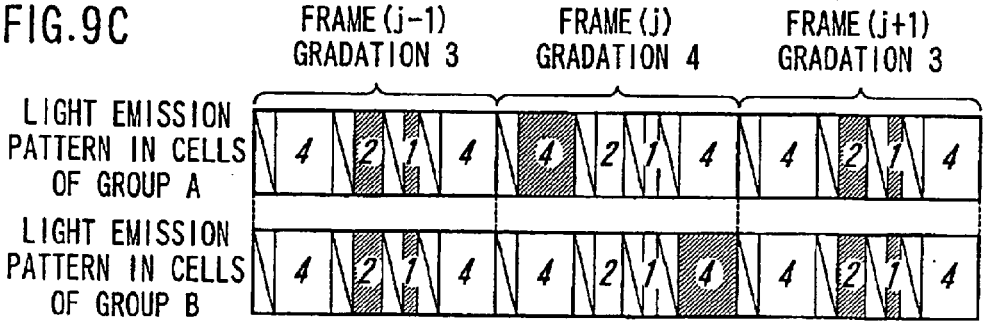
PRIOR ART FIG.9C

The area decision portion 87 includes a line memory 871, a gradient detection circuit 873 and a decision circuit 875. The line memory 871 is used for delaying the frame data Df and for transferring the same to the gradient detection circuit 873. The gradient detection circuit 873 calculates a luminance gradient (a gradation gradient quantity) between a noted pixel and the neighboring pixels for each pixel in synchronization with an input of frame data Df from the external device and the line memory 871. The calculated luminance gradient is transferred to the decision circuit 875 one after another. The line memory 871 can be replaced with a register or other memorizing elements for obtaining data of neighboring pixels necessary for the gradient detection. The decision circuit 875 decides whether the luminance value is the value that can generate a dynamic pseudo contour (the specific gradation value) or not for each pixel of the frame data Df inputted from the external device, as a first stage of process. When a subframe arrangement for a frame, i.e., an arrangement of a luminance weight is determined, a specific gradation is fixed. In general, a specific gradation is estimated by calculating a barycenter position of light emission. A specific gradation can also be estimated by an actual observation of a display. For example, in the subframe arrangement in which the Weight 4, the Weight 2, the Weight 1 and the Weight 4 are in the order as shown in FIG. 9, a dynamic pseudo contour can occur at the boundary between the Gradation 3 and the Gradation 4. In this case, the Gradation 4 is supposed as a specific gradation, for example. Next, as a process of the second stage, the decision circuit 875 decides whether the luminance gradient for pixel of the specific gradation is within a preset range or not. If the luminance gradient corresponds to a smooth gradation image, an area decision signal S87 that is outputted by the decision circuit 875 becomes active (the high level).

The above-mentioned selector 813 switches the selection only when the area decision signal S87 is the high level. If the area decision signal S87 is the low level, the selector 813 selects the output of the look-up table memory 811 (or 812) fixedly.

Figure 3:
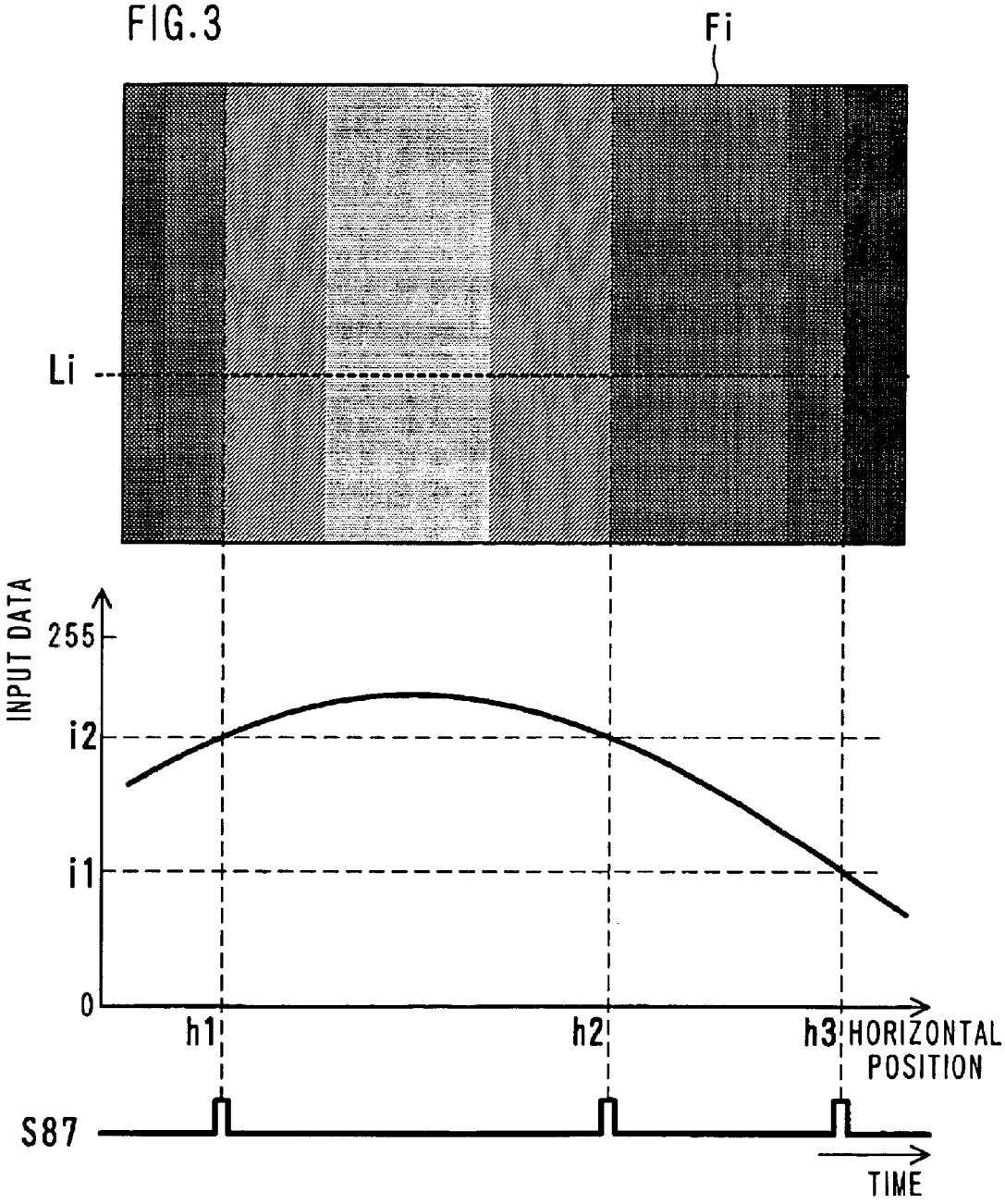
FIG. 3 shows a basic operation of an area decision portion.

FIG. 3 shows a basic operation of an area decision portion. Here, it is supposed that a dynamic pseudo contour may occur when a value of the input data is i1 or i2. In other words, the specific gradation is supposed to be i1 or i2. The thick line in the graph shown in FIG. 3 indicates a gradation gradient of the noted row Li in the frame Fi. In this example, the pixels at the horizontal positions h1 and h2 have the specific gradation i2, and the pixel at the horizontal position h3 has the specific gradation i1. Since these pixels are contained in a smooth gradation image, the area decision signal S87 becomes the high level during the period corresponding to the pixels.

Figure 4:
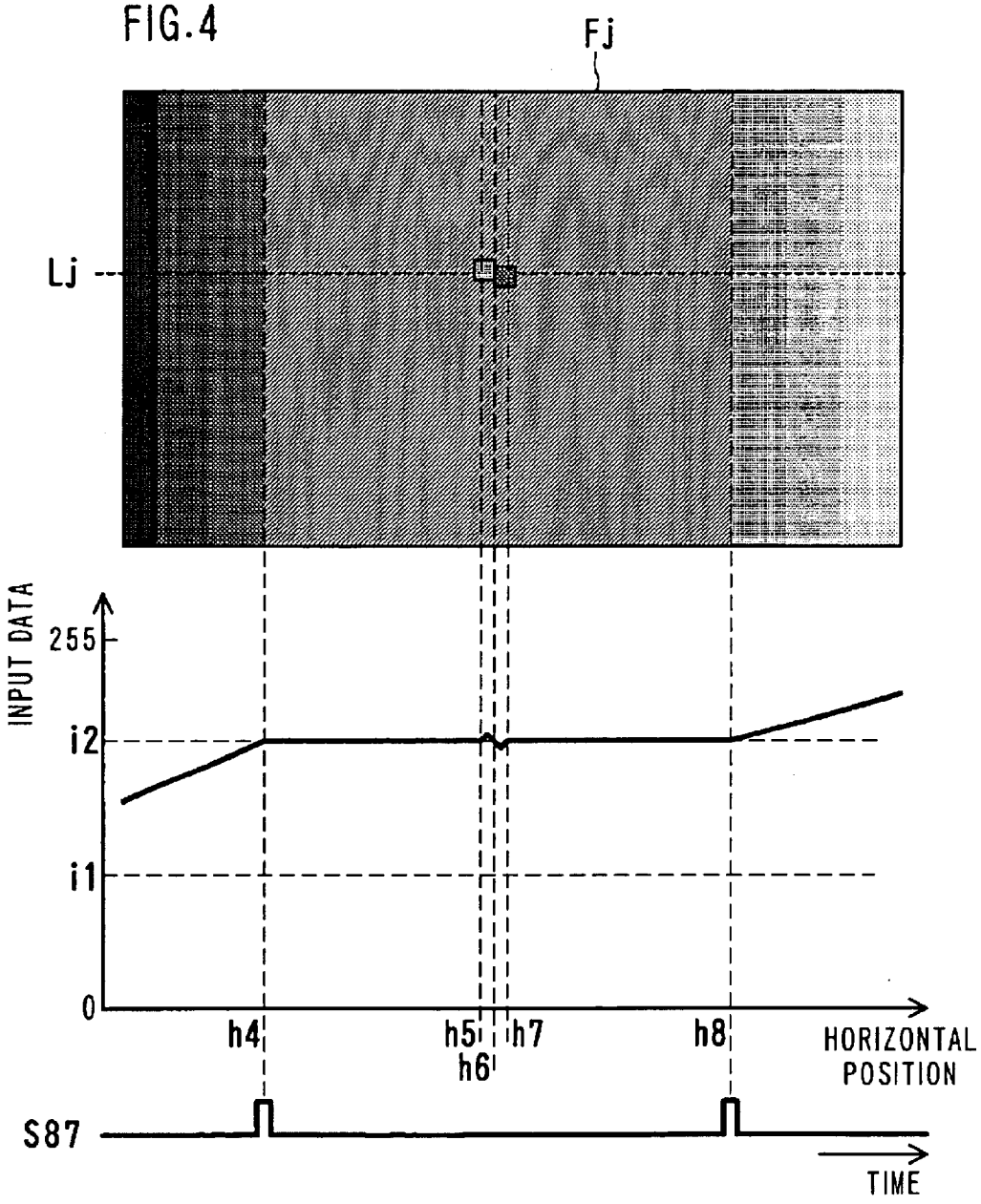
FIG. 4 shows a noise decision operation of the area decision portion.

FIG. 4 shows a noise decision operation of the area decision portion. Here, the specific gradations are denoted by i1 and i2, too. The thick line in the graph shown in FIG. 4 indicates a gradation gradient of the noted row Lj in the frame Fj. In this example, the pixels at the horizontal positions h4, h5, h6, h7 and h8 have the specific gradation i2. Since the pixels at the horizontal positions h4 and h8 are contained in a smooth gradation image, the area decision signal S87 becomes the high level during the period corresponding to the pixels. In contrast, since the horizontal positions h5, h6 and h7 are closed to one another, the gradation gradients of these positions are regarded as noises or small size image patterns, which are eliminated from the target of the superposition process. In other words, the area decision signal S87 is the low level during the period corresponding to the pixels at the horizontal positions h5, h6 and h7.

Figure 5:
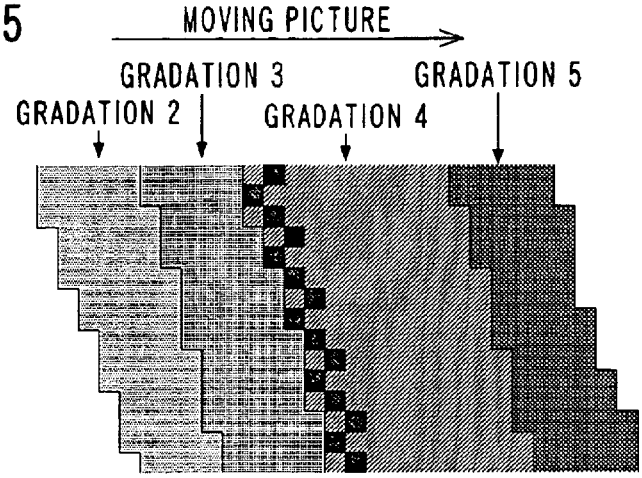
FIG. 5 shows reduction of dynamic pseudo contours according to the driving method of the present invention.

Thus, according to the function of the data conversion circuit 73 in the display device 100, the superposition method is applied to only the specific area of a frame that contains pixels having a specific gradation (the Gradation 4 in the illustrated example) and has a luminance gradient within a preset value range between neighboring pixels as shown in FIG. 5. Since the superposition method is not applied to the area that has a specific gradation but is not a specific area, a pattern noise due to a mix of plural subframe expressions does not occur widely.

[Second Embodiment]

In a second embodiment, the area decision circuit shown in FIG. 2 is modified as follows.

Figure 6:
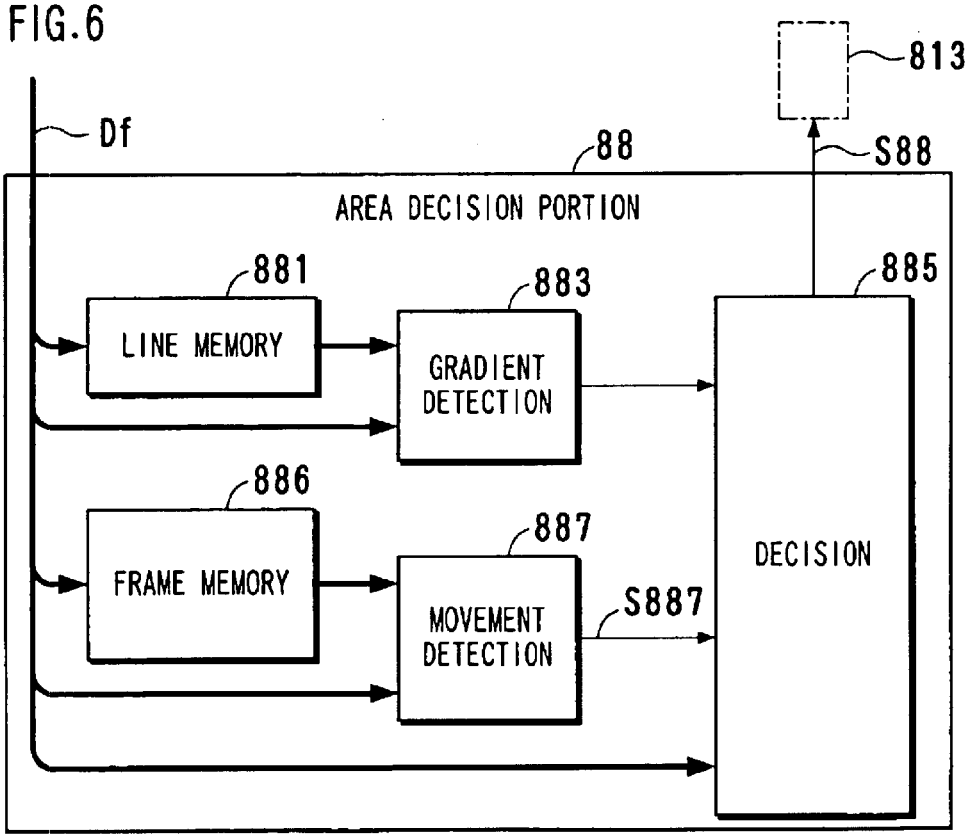
FIG. 6 is a block diagram showing an area decision portion according to a second embodiment.

FIG. 6 is a block diagram showing an area decision portion according to the second embodiment. The area decision portion 88 includes a line memory 881, a gradient detection circuit 883, a decision circuit 885, a frame memory 886 and a movement detection circuit 887. Functions of the line memory 881 and the gradient detection circuit 883 are the same as in the first embodiment.

The area decision portion 88, which performs a decision in accordance with the gradation and the luminance gradient, also decides whether the noted pixel is contained in an image of a moving object. Even if the noted portion in the display screen has a specific gradation, a dynamic pseudo contour can be recognized actually by human eyes only when the portion is moving and the observer is tracing the portion. The movement detection circuit 887 compares a frame transferred directly from the external device with the previous frame inputted via the frame memory 886 and outputs the comparison result as a detection signal S887. The detection signal S887 becomes active (the high level) when the noted pixels are contained in the image of a moving object. The decision circuit 885 provides the selector 813 with an area decision signal S88 that becomes active for pixels that have a specific gradation and a luminance gradient within a preset value range between the neighboring pixel and itself and are contained in the image of a moving object.

Figure 7:
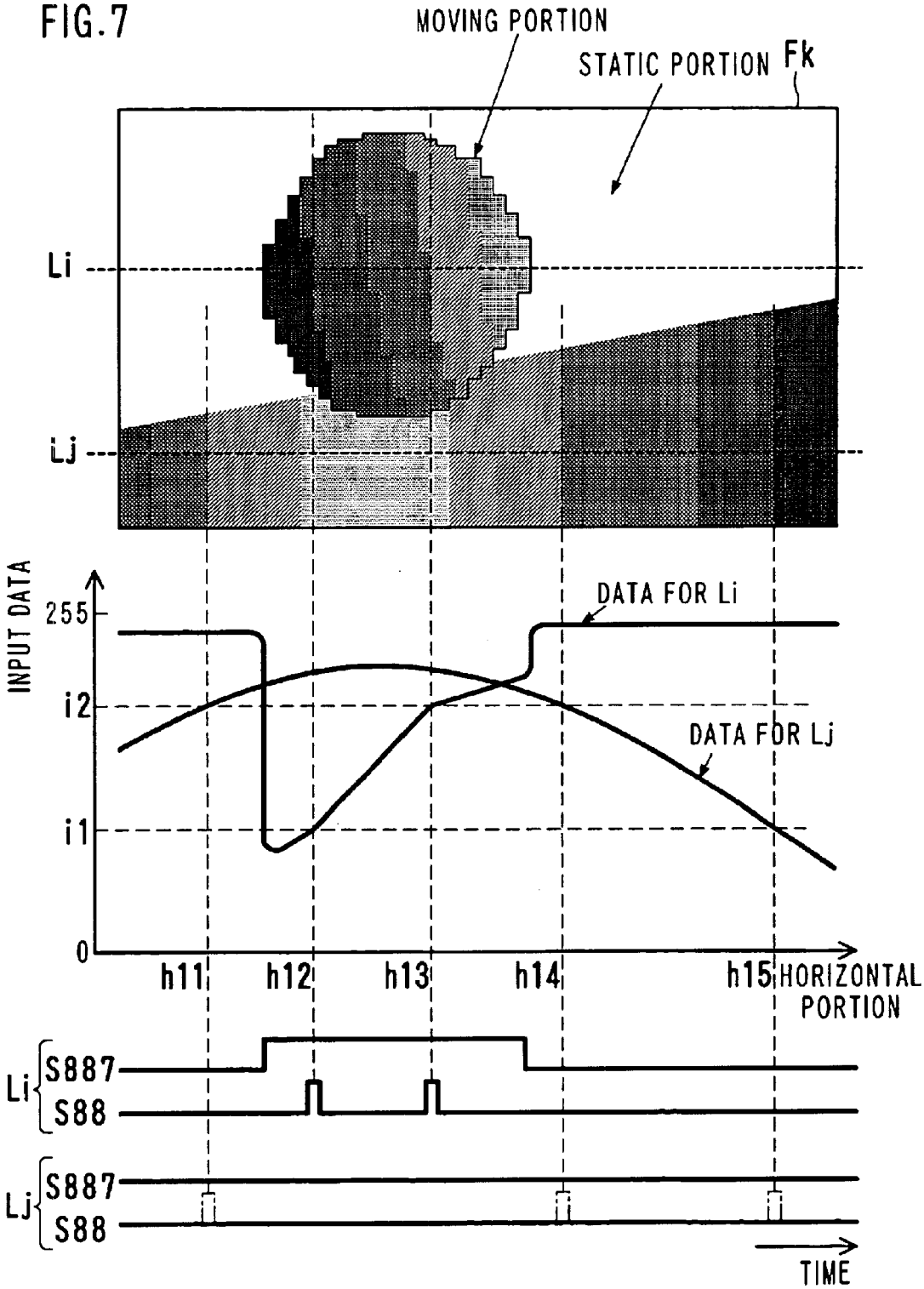
FIG. 7 shows an operation of the area decision portion according to the second embodiment.
Figure 8A:
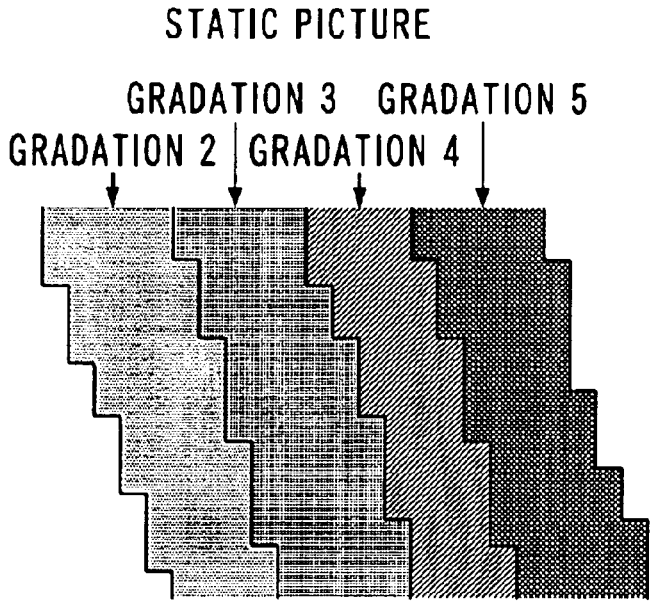
FIGS. 8A and 8B are explanatory diagrams of a dynamic pseudo contour.
Figure 8B:
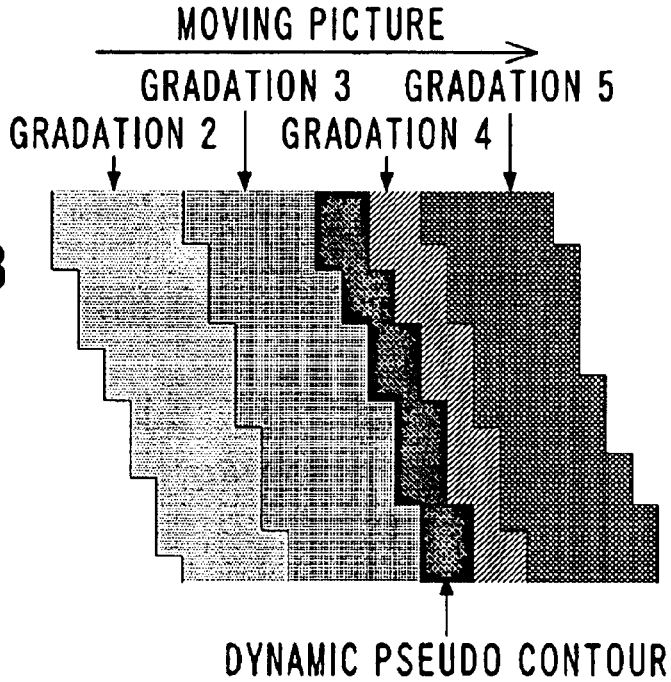

FIG. 7 shows an operation of the area decision portion according to the second embodiment. In the illustrated example, the specific gradations are denoted by i1 and i2. In the frame Fk, noting the row Li, the pixel at the horizontal position h12 has the specific gradation i1, and the pixel at the horizontal position h13 has the specific gradation i2. These pixels are contained in a smooth gradation image and are contained in a moving portion. Therefore, the area decision signal S88 becomes the high level during the period corresponding to these pixels. On the contrary, noting the row Lj, pixels at the horizontal positions h11 and h14 have the specific gradation i2, and the pixel at the horizontal position h15 has the specific gradation i1. These pixels are contained in a smooth gradation image. However, these pixels are contained in a static portion. Therefore, the area decision signal S88 is the low level during the period corresponding to these pixels.

According to the second embodiment, the superposition process can be controlled more effectively, and pattern noises can be reduced compared with the conventional method. It is not necessary that the movement detection circuit 887 detect a precise movement vector or a precise movement speed. It is sufficient that the movement detection circuit 887 can detect whether a pixel value has changed between frames or not. In addition, the frame memory is not required to have a data capacity for all screens. It can have a data capacity for thinned-out screens. Therefore, a simple circuit structure can be used.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a plasma display panel by replacing a frame with a plurality of subframes having weights of luminance and by setting light emission of cells on and off for each subframe so as to realize a gradation display, the method comprising:

assigning a luminance weight to each of the subframes so that plural subframe expressions, as combinations of subframes to be lighted, are prepared for a specific gradation; and applying a superposition method in which the plural subframe expressions are mixed only to the specific area that is included in the frame, is made of pixels having the specific gradation and has a luminance gradient within a preset value range between the neighboring pixels.

2. The method according to claim 1, wherein the specific area is an area larger than a predetermined value.

3. A method for driving a plasma display panel by replacing a frame with a plurality of subframes having weights of luminance and by setting light emission of cells on and off for each subframe so as to realize a gradation display, the method comprising:

assigning a luminance weight to each of the subframes so that plural subframe expressions, as combinations of subframes to be lighted, are prepared for a specific gradation; and applying a superposition method in which the plural subframe expressions are mixed only to the specific area that is included in the frame, made of pixels having the specific gradation and has a luminance gradient within a preset value range between the neighboring pixels and is a portion of a moving object different from a previous frame.

4. The method according to claim 3, wherein the specific area is an area larger than a predetermined value.

5. A device for driving a plasma display panel by replacing a frame with a plurality of subframes and by setting light emission of cells on and off for each subframe so as to realize a gradation display, wherein:

the device comprises an area decision circuit dividing the frame into a specific area that is made of pixels having a specific gradation and a luminance gradient within a preset value range between neighboring pixels and other areas, and the device performs a light emission control for the specific area of the frame by applying a superposition method in which plural subframe expressions are mixed while performing another light emission control for other areas without applying the superposition method.

6. A device for driving a plasma display panel by replacing a frame with a plurality of subframes and by setting light emission of cells on and off for each subframe so as to realize a gradation display, wherein:

the device comprises an area decision circuit dividing the frame into a specific area that is made of pixels having a specific gradation and a luminance gradient within a preset value range between the neighboring pixels and is a portion of a moving object, different from a previous frame and other areas, and the device performs a light emission control for the specific area of the frame by applying a superposition method in which plural subframe expressions are mixed while performing another light emission control for other areas without applying the superposition method.

7. A display device, comprising:

an AC type plasma display panel; and a driving device driving the plasma display panel and comprising:

an area decision circuit dividing the frame into a specific area that is made of pixels having a specific gradation and a luminance gradient within a preset value range between neighboring pixels and other areas, and the driving device performs a light emission control for the specific area of the frame by applying a superposition method in which plural subframe expressions are mixed while performing another light emission control for other areas without applying the superposition method.

8. A display device, comprising:

an AC type plasma display panel; and a driving device driving the plasma display panel and comprising:

an area decision circuit dividing the frame into a specific area that is made of pixels having a specific gradation and luminance gradient within a preset value range between neighboring pixels and is a portion of a moving object different from a previous frame and other areas, and the driving device performs a light emission control for the specific area of the frame by applying a superposition method in which plural types of subframe expressions are mixed while performing another light emission control for other areas without applying the superposition method.

* * * * *

UNITED STATES PATENT AND TRADEMARK OFFICE

CERTIFICATE OF CORRECTION

PATENT NO. : 6,924,778 B2
DATED : August 2, 2005
INVENTOR(S) : Awamoto et al.

It is certified that error appears in the above-identified patent and that said Letters Patent is hereby corrected as shown below:

Column 7,
Line 12, after "frame," insert -- is --.

Signed and Sealed this

Eleventh Day of April, 2006

JON W. DUDAS
*Director of the United States Patent and Trademark Office*